US008771910B2

(12) United States Patent
Fujita et al.

(10) Patent No.: US 8,771,910 B2
(45) Date of Patent: Jul. 8, 2014

(54) ELECTROPHOTOGRAPHIC PHOTORECEPTOR

(71) Applicants: Toshiyuki Fujita, Tokyo (JP); Hirofumi Hayata, Tokyo (KP)

(72) Inventors: Toshiyuki Fujita, Tokyo (JP); Hirofumi Hayata, Tokyo (KP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/715,359

(22) Filed: Dec. 14, 2012

(65) Prior Publication Data

US 2013/0157182 A1 Jun. 20, 2013

(30) Foreign Application Priority Data

Dec. 20, 2011 (JP) ..... 2011-278006

(51) Int. Cl.
*G03G 5/00* (2006.01)

(52) U.S. Cl.
USPC ..... 430/66

(58) Field of Classification Search
USPC ..... 430/66
See application file for complete search history.

(56) References Cited

U.S. PATENT DOCUMENTS 4,477,549 A * 10/1984 Fujimaki et al. ..... 430/54

FOREIGN PATENT DOCUMENTS

| | | |
|---|---|---|
| JP | 63-261269 | 10/1988 |
| JP | 09-043885 | 2/1997 |
| JP | 11-288121 | 10/1999 |
| JP | 2002-333733 | 11/2002 |
| JP | 2009-069241 | 4/2009 |
| JP | 2009-075163 | 4/2009 |
| JP | 2010-134071 | 6/2010 |
| JP | 2010-164646 | 7/2010 |
| JP | 2011-095648 | 5/2011 |

OTHER PUBLICATIONS

Japanese Office Action, Notification of Reasons for Refusal, Japanese Patent Application No. 2011-278006, Dispatch Date: Feb. 18, 2014 (3 pages).
English translation of Japanese Office Action, Notification of Reasons for Refusal, Japanese Patent Application No. 2011-278006, Dispatch Date: Feb. 18, 2014 (6 pages).

* cited by examiner

*Primary Examiner* — Mark A Chapman
(74) *Attorney, Agent, or Firm* — Lucas & Mercanti, LLP

(57) ABSTRACT

Disclosed is an electrophotographic photoreceptor including a conductive supporting body, a photosensitive layer and a protective layer. In the electrophotographic photoreceptor, at least the photosensitive layer and the protective layer are sequentially layered on the conductive supporting body, and the protective layer includes P-type semiconductor particles.

19 Claims, 2 Drawing Sheets

ELECTROPHOTOGRAPHIC PHOTORECEPTOR

BACKGROUND OF THE INVENTION

1. Field of the Invention

The present invention relates to an electrophotographic photoreceptor, and specifically to an electrophotographic photoreceptor used in an image forming apparatus to which electrophotographic method applies.

2. Description of Related Art

In recent years, organic photoreceptors including organic photo conductive materials are widely used as electrophotographic photoreceptors. Organic photoreceptors have advantages that they are easy to develop materials corresponding to various types of lithography light sources including visible light to ultra violet light, that materials which do not cause environmental pollution can be selected to be used and that manufacturing cost is inexpensive comparing to inorganic photoreceptors.

On the other hand, because electrophotographic photoreceptors (hereinafter, also called a photoreceptor) directly receives electrical or mechanical external force due to electrification, exposure, development, transfer, cleaning and the like, it is expected that electrophotographic photoreceptors have durability so as to stably maintain electrification stability, electric potential retentivity and such like even when image forming is repeatedly performed.

Especially, with the trend of digitalization in the recent years, demand for high definition and high quality image, is increasing and small particle toners of polymerization method such as a solution suspension toner, emulsion aggregation toner and the like became the mainstream. Such small particle toner has great adhesion on the surface of a photoreceptor and residual toner such as residual toner from transfer attached to the surface of the photoreceptor cannot be removed sufficiently. In a cleaning method using a rubber blade, phenomenon such as "slip through of toner" where toner slips through the blade, "blade turning" where the blade turns over, so-called "blade squeaking" where the photoreceptor and the blade generate friction sound and the like are likely to occur. The blade needs to have great contacting pressure with respect to the photoreceptor in order to resolve the "slip through of toner". However, there is a problem that the durability becomes insufficient due to attrition of the surface of the organic photoreceptor by repeatedly using the photoreceptor. Further, photoreceptor is expected to have sufficient durability with respect, to degradation due to ozone and nitrogen oxide which are generated at the time of electrification.

In view of the above problems, there is suggested a technique to improve the mechanical strength of photoreceptors by providing protective layer (hereinafter, also called surface layer) on the surfaces of photoreceptors.

In particular, JP H11-288121 and JP 2009-69241 suggest techniques to manufacture a photoreceptor having high durability with respect to attrition and scars on the surface due to friction of a cleaning blade or the like by using a polymerizable compound generally called curable compound as the photoreceptor protective layer and by causing hardening reaction after applying such, polymerizable compound. Further, JP 2002-333733 suggests a technique to improve mechanical strength by dispersing inorganic fine particles such as silica on the protective layer.

In recent years, electrophotographic image forming apparatus has been rapidly expanding its use in the field of light printing, and greater durability and higher image quality is being demanded in electrophotographic photoreceptor. However, electrophotographic photoreceptor that fully satisfies the demand in terms of durability and image quality cannot be obtained in conventional techniques, and there has been increasing demands for techniques which will provide greater durability and higher image quality in electrophotographic photoreceptor.

However, because charge transport ability of such protective layer is poor, there is a problem that the photographic sensitivity characteristic as electrophotographic photoreceptor is to be degraded by being provided with the protective layer comparing to an electrophotographic photoreceptor without protective layer. In order to resolve this problem, the protective layer can have charge transport ability by including charge transport material in the protective layer. However, because, charge transport material of organic compound generally has a plasticizing effect, strength of the protective layer is degraded due to inclusion of charge transport material. In view of the above, there is disclosed a technique to give charge transport ability to the protective layer and to obtain a protective layer having great durability to attrition. For example, JP 2010-164646 discloses a technique regarding a protective layer made by using a radical polymerizable compound having charge transport ability, a radical polymerizable compound not having charge transport ability and a filler which is treated with a surface processing agent including polymerizable functional group and by causing hardening reaction thereof.

SUMMARY OF THE INVENTION

However, sufficient charge transport ability cannot be obtained in the above technique and durability to attrition is not satisfactory.

Further, metallic oxide particles such as silicon oxide, aluminum oxide or titanium dioxide are added as filler here. However, although improvement in durability to attrition can be expected to a certain extent in these metallic oxide particles, hole transport ability is not sufficient and density difference occurs in images between photoreceptor cycles, that is, so-called image memory occurs, and such improvement in durability to attrition is not enough to satisfy both durability to attrition and image characteristics.

The present invention was made in view of the above problems and circumstances, and an object of the present invention is to provide an electrophotographic photoreceptor having good durability to attrition and good stability in durability to attrition and image characteristics without occurrence of density difference (image memory) in images between photoreceptor cycles.

In order to achieve the above purpose, in the process of reviewing what caused the above problems, the inventors found out that the abrasion resistance and the image characteristics can be resolved by including P-type semiconductor particles in the protective layer of the electrophotographic photoreceptor.

That is, in order to achieve, at least one of the above described purposed of the present invention, the electrophotographic photoreceptor which reflects one aspect of the present invention includes a conductive supporting body, a photosensitive layer and a protective layer, and at least the photosensitive layer and the protective layer are sequentially layered on the conductive supporting body, and the protective layer includes P-type semiconductor particles.

Preferably, the P-type semiconductor particles are a compound expressed by a general formula (1)

$$CuMO_2 \qquad \text{General formula (1)}$$

(M in the formula expresses a group 13 element in periodic table).

Preferably, the P-type semiconductor particles are particles selected from $CuAlO_2$, $CuGaO_2$ and $CuInO_2$.

Preferably, the protective layer includes a component obtained by curing the P-type semiconductor particles and a curable compound.

Preferably, the P-type semiconductor particles are treated with a surface processing agent including a reactive organic group.

Preferably, the curable compound is a polymerizable monomer including at least either of a acryloyl group and a methacryloyl group in a molecule thereof.

Preferably, a number average primary particle size of the P-type semiconductor particles is between 1 nm or more and 300 nm or less.

Preferably, the P-type semiconductor particles are particles prepared by a plasma method.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
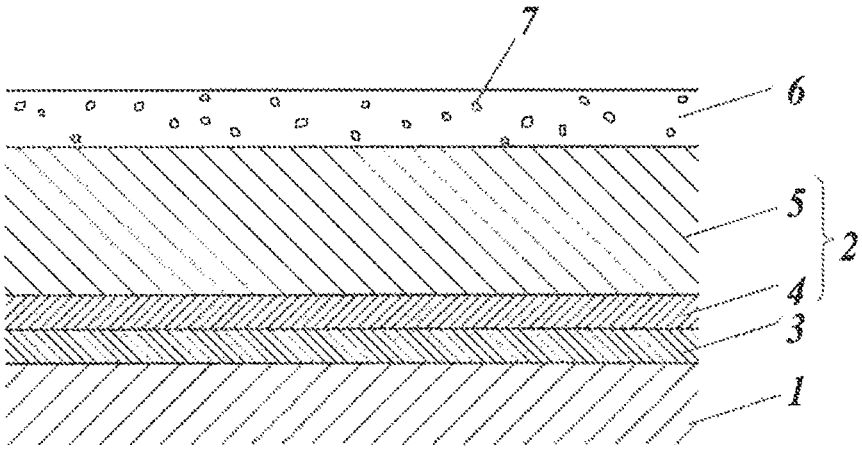
FIG. 1 is a schematic view showing an example of layer configuration of a photoreceptor according to the present invention.

The electrophotographic photoreceptor of the present, invention is characteristic in an aspect that the electrophotographic photoreceptor is formed by sequentially layering at least a photosensitive layer and a protective layer on a conductive supporting body wherein the protective layer includes P-type semiconductor particles. This characteristic is a technical feature which is common among the inventions according to claim 1 to claim 8.

Further in the present invention, it is preferable that the P-type semiconductor particles are compounds indicated by the following general formula (1) because high hole transport capability can be obtained and great improvement effect in image memory can be observed.

$$CuMO_2 \qquad \text{General formula (1)}$$

(here, M in the formula expresses a group 13 element in the periodic table)

Further, in the present invention, it is preferable that the P-type semiconductor particles are particles selected from $CuAlO_2$, $CuGaO_2$ and $CuInO_2$ because even higher hole transport capability can be obtained and great improvement effect in image memory can be observed.

Moreover, in the present invention, it is preferable that the protective layer includes a component obtained by curing the P-type semiconductor particles and a curable compound because abrasion resistance is improved, and a highly durable electrophotographic photoreceptor can be obtained.

Furthermore, in the present invention, it is preferable that the P-type semiconductor particles are processed with surface processing agent including reactive organic group because the abrasion resistance is improved and a highly durable electrophotographic photoreceptor can be obtained.

Further, in the present invention, it is preferable that the curable compound is a polymerizable monomer including at least either of acryloyl group and methacryloyl group in molecules thereof because the abrasion resistance can be improved even more and a highly durable electrophotographic photoreceptor can be obtained. Moreover, in the present invention, it is preferred that the number average primary particle size of the semiconductor particles is within the range between 1 nm or more and 300 nm or less (including 1 nm and 300 nm).

Moreover, it is preferable that the semiconductor particles are particles made by a plasma technique.

As an advantage of the embodiment of the present invention, an electrophotographic photoreceptor having great stability in its abrasion resistance and image characteristics with high abrasion resistance and wherein density difference in images between photoreceptor cycles (image memory) does not occur can be provided.

With regard to manifestation mechanism and mechanism of action of the advantages obtained in the embodiment of the present invention are not clear. However, they are speculated as described below.

Generally, the charge transport material used in an electrophotographic photoreceptor is an organic compound and this has high hole transport ability. However, due to its plasticizing effect, abrasion resistance of an electrophotographic photoreceptor using organic compound is usually insufficient. On the other hand, there has been an attempt to improve the abrasion resistance by providing a protective layer on the photosensitive layer and adding metallic oxide particles such as silicon oxide, aluminum oxide, titanium oxide or the like in the protective layer to bring out the filler effect of such metallic oxide particles in the purpose of improving the abrasion resistance. However, these metallic oxide particles do not have sufficient hole transport ability and it is considered that image memory occurs because charges (carrier) are trapped in the protective layer.

Therefore, it is speculated that by adding P-type semiconductor particles in the protective layer of the photoreceptor in order to satisfy both the abrasion resistance and the image characteristics, the abrasion resistance is improved due to the degree of hardness of the P-type semiconductor particles being high, sufficient hole transport capability can foe secured in the protective layer because, the P-type semiconductor particles have hole transport capability and image memory can be improved because charges are not to be trapped leading to satisfying both the abrasion resistance and the image characteristics.

Hereinafter, the constituent elements of the present invention and embodiments for implementing the present invention will be described in detail. Here, in the present application, notions of "or more" and "or less" are used in the meaning that, the numerical values recited just before them are included as the lower limitation value and the upper limitation value.

(Outline of the Electrophotographic Photoreceptor According to the Present Invention)

The electrophotographic photoreceptor according to the present invention is characteristic in an aspect that the electrophotographic photoreceptor is formed by sequentially layering at least a photosensitive layer and a protective layer on a conductive supporting body wherein the protective layer includes P-type semiconductor particles.

(P-Type Semiconductor Particles)

The P-type semiconductor particles used in the protective layer of the electrophotographic photoreceptor according to the present invention will be described.

P-type semiconductor particles are semiconductor particles in which holes are used as carriers which transport charges. That is, P-type semiconductor particles are semiconductors wherein their holes are the majority carriers.

A compound expressed by the following general formula (1) is preferred to be used as for the P-type semi conductor particles used in the present invention.

$CuMO_2$ General formula (1)

(here, M in the formula expresses a group 13 element in the periodic table)

In particular, boron (B), aluminum (Al), gallium (Ga), indium (In) and thallium (Tl) are suggested as the group 13 element. The group 13 elements preferably used in the present invention are aluminum, gallium and indium, and $CuAlO_2$, $CuGaO_2$ and $CuInO_2$, for example, are suggested for preferred P-type semiconductor particles expressed by the general formula (1). By adding such P-type semiconductor particles in the protective layer of the electrophotographic photoreceptor, a high quality electrophotographic photoreceptor which has great abrasion resistance and in which image memory does not occur can be obtained.

It is preferable that the number average primary particle size of the P-type semiconductor particles is within the rage between 1 nm or more and 300 nm or less, and more preferably, within the rage between 3 nm or more and 100 nm or less.

The P-type semiconductor particles according to the present invention can be made by a plasma technique, for example. The direct-current plasma arc method, high frequency plasma method, plasma jet method, and the like are suggested as methods of plasma techniques.

In the direct-current plasma arc method, metallic alloy is used as anode consumption electrode, and plasma flame occurs from a cathode electrode. Then, P-type semiconductor particles are obtained, by heating and vaporizing the metallic alloy in the anode side and oxidizing and cooling the metallic alloy.

In the high frequency plasma method, thermal plasma that occurs when a gas is heated by high frequency inductive discharge under atmospheric pressure is used. In the plasma evaporation, solid particles are injected at the center of an inert gas plasma and evaporated, while passing through the plasma and then, the high temperature vapor is quenched and condensed to produce ultrafine particles.

In the plasma, techniques, argon plasma, hydrogen plasma, and the like are obtained when arc discharge is performed in argon atmosphere which is an inert gas and in hydrogen, nitrogen or oxygen atmosphere which are diatomic molecule gas. However, hydrogen (nitrogen, oxygen) plasma generated due to heat dissociation of diatomic molecule gas is rich in reactivity to a great extent comparing to molecular gas and thus, it is also called, reactive arc plasma in distinction from inert gas plasma. Among the above, oxygen plasma method is effective as a method to produce P-type semiconductor particles.

The number average primary particle size of the above P-type semiconductor particles can be calculated by photographing photographs which are magnified 100,000 times with a scanning electron microscope (for example, JSM-7500F manufactured by Japan Electron Optical Laboratory Co., Ltd.) and by calculating the number average primary particle size of photograph images (excluding agglomerates) of randomly selected 300 particles loaded by a scanner using an automatic image processing analysis apparatus (for example, "LUZEX (registered trademark) AP" software Ver. 1.32 manufactured by Nikon Corporation).

The adding amount of P-type semiconductor particles in the protective layer is preferably between 30 part, by weight or more and 300 part by weight or less with respect to 100 part by weight of curable compound, and more preferably, between 50 part by weight or more to 200 part by weight or less with respect to 100 part by weight, of curable, compound. P-type semiconductor particles can be used alone or in combinations of two or more types.

<<Configuration of Protective Layer>>

Improvement of abrasion, resistance and remediation of image memory are problems to be solved in the electrophotographic photoreceptor of the present invention, and the electrophotographic photoreceptor has configuration where at least a photosensitive layer and a protective layer are sequentially layered on a conductive supporting body. In the protective layer, P-type semiconductor particles are included. Further, it is preferable that the protective layer includes a binder resin. It is preferable that a component obtained by curing a curable compound is included in the binder resin.

As for the binder resin which can be used in the protective, layer of the present invention, a component obtained by curing a curable compound is preferred. However, well known resins such, as a polyester resin, a polycarbonate resin, a polyurethane resin, a silicone resin and the like can be suggested other than a curable compound. Further, a curable compound and a resin other than the curable compound can be used in combination.

(Curable Compound)

Radical polymerizable compounds are suggested as for the curable compound to be used in the protective layer according to the present invention and a polymerizable monomer including at least one of acryloyl group and methacryloyl group as radical polymerizable reactive group is preferred to be used as the radical polymerizable compound.

As for such, polymerizable monomer, the following compounds can be exemplified. However, the polymerizable monomers which can be used in the present invention are not limited to the followings.

[Chemical 1]

M1

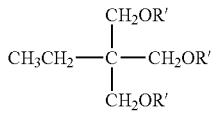

M2

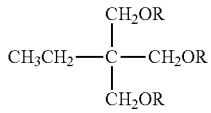

M3

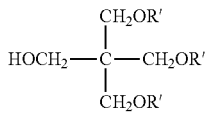

M4

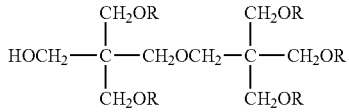

-continued

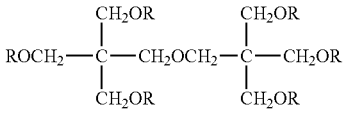

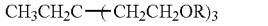

[Chemical 2]

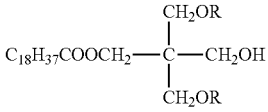

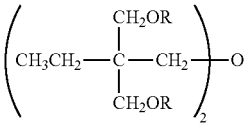

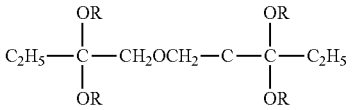

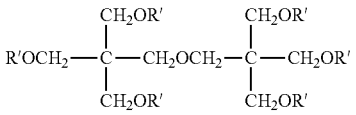

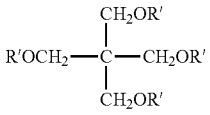

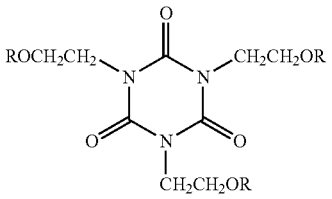

The above radical polymerizable compounds are well known and can be obtained as commercialized products.

Here, R expresses the following acryloyl group and R' expresses the following methacryloyl group.

[Chemical 3]

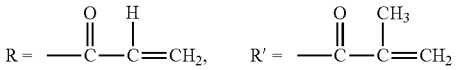

(Surface Processing P-Type Semiconductor Particle)

Preferably, the P-type semiconductor particles used in the protective layer according to the present invention are treated with a surface processing agent, and more preferably, surfaces thereof are treated with a surface processing agent including a reactive organic group.

(Surface Processing Agent)

As for the surface processing agent according to the present invention, a surface processing agent which reacts with a hydroxyl group or the like, that exists at the surface of a P-type semiconductor particle is preferred, and a silane coupling agent, a titanate coupling agent and the like are suggested as such surface processing agent. Further, in the present invention, it is preferred, to use a surface processing agent including a reactive organic group in order to even more harden the protective layer, and a surface processing agent including a radical polymerizable reactive group is preferable as such surface processing agent including a reactive organic group. Such radical polymerizable reactive group can form a strong protective film by also reacting with the curable compound of the present invention. As for such surface processing agent including a radical polymerizable reactive group, a silane coupling agent including a radical polymerizable reactive group such as a vinyl group, an acryloyl group or the like is preferred, and the following well known compounds can be exemplified as such surface processing agent, including a radical polymerizable reactive group.

S-1: $CH_2{=}CHSi(CH_3)(OCH_3)_2$
S-2: $CH_2{=}CHSi(OCH_3)_3$
S-3: $CH2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)C_{12}$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_6)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_3$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Further, as for the surface processing agent, a silane compound including a radical polymerizable reactive organic group can be used other than the above S-1 to S-36. Such surface processing agents can be used alone or in combination of two or more types thereof.

(Preparation Method of Surface Processing P-Type Semiconductor Particles)

When performing the surface processing, it is preferred, to perform the processing with, a wet media dispersion apparatus by using the surface processing agent in the amount between 0.1 part per weight or more and 100 part per weight or less and a solvent in the amount between 50 part per weight or more and 5,000 part per weight or less with respect to particles in the amount of 100 part per weight. Further, the processing may be performed with a dry-type apparatus.

Hereinafter, the surface processing method for preparing metallic oxide particles whose surfaces are treated evenly with the surface processing agent will be described.

That is, by performing elutriation on slurry (suspension of solid particles) which includes the P-type semiconductor particles and the surface processing agent, the P-type semiconductor particles are to be refined and the surface processing can be performed, on the particles at the same time. Thereafter, by removing the solvent and pulverizing, the P-type semiconductor particles on which the surface processing is performed evenly with the surface processing agent can be obtained.

The wet media dispersion apparatus which is the surface processing apparatus used in the present invention is an apparatus that includes a pulverization and dispersion step by grinding the P-type semiconductor agglomerates by filling a container with beads as media and rotating the stirring disk which is attached so as to be vertical with respect to the rotation axis at a high speed. As for the configuration, it is sufficient that it is in a format that the P-type semiconductor particles can be dispersed, sufficiently and the surface processing can be performed when performing the surface processing on the P-type semiconductor particles and for example, various types of styles such as a vertical type, horizontal type, continuous method, batch method and the like can be applied. In particular, a sand mill, an ultra visco mill, a pear mill, a grain mill, a dyne mill, an agitator mill, a dynamic, mill or the like can be used. These dispersive type apparatuses perform fine graining and dispersion by crushing performance, friction, shearing, shearing stress and the like using a graining medium (media) such as a ball and beads.

As for the beads to be used in the above wet media dispersive type apparatus, beads whose raw material is glass, alumina, zircon, zirconia, steal, flint or the like can be used. However, beads made of zirconia or beads made of zircon are particularly preferred. Further, as for the size of the beads, beads whose size is 1 mm in diameter or more to 2 mm in diameter or less are usually used. However, in the present invention, it is preferred to use the beads whose size is 0.1 mm in diameter or more to 1.0 mm in diameter or less.

As for the disk and inner walls of the container used in the wet media dispersive type apparatus, various types of disks and inner walls such as those made of various types of materials can be used such as those made of stainless, nylon, ceramic and the like. However, in the present invention, a disk and inner-walls of the container made of ceramic such as zirconia, silicon carbide and the like are particularly preferred.

By the wet processing as described above, P-type semiconductor particles wherein surfaces thereof are treated with a surface processing agent can be obtained.

The protective layer of the present invention can be formed by including a polymerization initiator or lubricant particles as needed in addition to the above.

(Polymerization Initiator)

As for the method, to cause curing reaction of the curable compound which can be used, in the protective layer of the present invention, curing reaction can be caused by a method using electron beam cleavage reaction, a method using light and heat under the presence of radical polymerization initiator and the like. When curing reaction is to be caused by using a radical polymerization initiator, a photoinitiator or a thermal polymerization initiator can be used as the polymerization initiator. Further, both photo and thermal initiators can be used in combination.

As for the polymerization initiator to be used in the present invention, thermal polymerization initiators of azobis compound such as 2,2'-azobisisobutyronitrile, 2,2'-azobis(2,4-dimetyl azobisvaleronitrile), 2,2'-azobis(2-methulbutyronitrile) and or peroxide such as benzoyl peroxide (BPO), di-tert-butylhydroperoxide, tert-butylhydroperoxide, chlorobenzoyl peroxide, diclorobenzoyl peroxide, bromomethyl benzoyl peroxide and layroyl peroxide are suggested.

Further, as for the photoinitiator, an acetophenone or ketal photoinitiator such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 (Irgacure 363: manufactured by BASF Japan Ltd.), 2-hydroxy-2-methyl-1-phenylpropane-1-one, 2-methyl-1-morpholino(4-methlthiophenyl) propane-1-one, 1-phenyl-1,2-propanedione-2-(o-ethoxycarbonyl)oxime and the like, a benzoinether photoinitiator such as benzoin, benzoin methyl ether, benzoin ethyl ether, benzoin isobutyl ether, benzoin isopropyl ether and the like, a benzophenone photoinitiator such as benzophenone, 4-hydroxybenszophenone, methyl o-benzoylebenzoate, 2-benzoylnaphthalene, 4-benzoyl biphenyl, 4-benzoyl phenyl ether, acrylic benzophenone, 1,4-benoylbenzene and the like and a thioxanthone photoinitiator such as 2-isopropylthioxianthone, 2-chlorothioxanthone, 2,4-dimethylthioxanthone, 2,4-diethylthioxanthone, 2,4-dichlorothioxanthone and the like are suggested.

As for other photoinitiators, ethylanthraquinone, 2,4,6-thrimethylbenzoyldihenylphosphineoxide, 2,4,6-thrimethylbenzoylphenylethoxyphosphineoxide, bis(2,4,6-thrimethylbenzoyl)phenylphosphineoxide (Irgacure 819: manufactured by BASF Japan Ltd.), bis(2,4-dimethoxybenzoyl)-2m 4,4-thrimethylpentylphosphineoxide, methylphenylglyoxyester, 9,10-phenanthrene, acridine compound, triazine compound, imidazole compound, and the like are suggested. Further, a material having photoinitiation effect can be used alone or can be used in combination with the above mentioned polymerization initiator. For example, triethanolamine, methyldiethanolamine, ethyl 4-dimethylaminobenzoate, isoamyl 4-dimethylaminobenzoate, benzoic acid (2-dimethylamino) ethyl, 4,4'-dimethylaminobenzophenone and the like are suggested.

As for the polymerization initiator used in the present invention, photoinitiator is preferred and alkylphenone compound and phosphineoxide compound are preferred. Further, initiators having α-hydroxyasetophenon structure or acylphosphine oxide structure are more preferred. These polymerization initiators may be used alone or may be used in combination or two or more types thereof. The contained amount of polymerization initiator is between 0.1 part per weight or more and 40 part per weight or less with respect to 100 part per weight of polymerizable compound, more preferably, between 0.5 part per weight or more and 20 part per weight or less with respect to 100 part per weight of polymerizable compound.

(Lubricant Particles)

Further, various types of lubricant particles can be added in the protective layer. For example, resin particles including fluorine atoms can be added. As for such resin particles including fluorine atoms, it is preferable to arbitrarily select one type or two ore more types from polytetrafluoroethylene, polychlorotrifluoroethylene, chlorohexafluoro ethylene propylene resin, polyvinyl fluoride, polyvinylidene fluoride, difluoride dichloride ethylene resin and copolymer of the above. However, polytetrafluoroethylene and polyvinylidene fluoride are particularly preferred.

(Solvent)

As for the solvent to be used in forming of the protective layer, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, diethylamine are suggested. However, the solvent is not limited to these described above.

(Forming of Protective Layer)

The protective layer can be made by applying an application liquid which is prepared by combining a radical polymerizable curable compound and P-type semiconductor particles whose surfaces are processes and adding well known resin, polymerization initiator, lubricant particles, antioxidant and the like as needed on the surface of photosensitive layer by a well known method, air drying or thermal drying and performing curing processing thereafter. It is preferred that the thickness of protective layer is between 0.2 μm or more and 10 μm or less, and more preferably, between 0.5 μm or more and 6 μm or less.

In the present invention, with respect to curing of the protective layer, it is preferred that the applied film is irradiated by actinic rays to generate radical and polymerize and curing is realized by forming cross linkages due to crosslinking reaction between and within molecules to generate a cured resin. As for the actinic rays, light such as ultraviolet rays, visible light, and the like and electron beams are preferred, and ultraviolet rays are particularly preferred in terms of usability and the like.

As a source of ultraviolet rays, any light source can be used without limitation as long as the light source generates ultraviolet rays. For example, low-pressure mercury lamp, medium-pressure mercury lamp, high-pressure mercury lamp, super-high pressure mercury lamp, carbon arc lamp, metal-halide lamp, xenon lamp, lamps using flash (pulsed) xenon or ultraviolet LED and the like can be used. Although irradiation condition will be different depending on each lamp, irradiation dose of actinic rays is usually between 1 mJ/cm2 or more and 20 mJ/cm2 or less, and more preferably, between 5 mJ/cm2 or more and 15 mJ/cm2 or less. Preferably, output voltage of the light source is between 0.1 kW or more and 5 kW or less, and it is particularly preferable to be between 0.5 kW or more and 3 kW or less.

As for a source of electron beams, there is no specific limitation with respect to electron beam, emitting device, and usually, a curtain beam type electron beam emitting device from which great output of electron beams can be obtained at relatively low cost is effectively used as an electron beam accelerator for electron beam emission. It is preferred that accelerating voltage at the time of electron ray emitting is between 100 kV or more and 300 kV less. It is preferred that absorbed dose is between 0.005 Gy or more and 100 kGy or less (between 0.5 rad or more and 10 Mrad or less).

Irradiation time period of actinic rays is a time period needed irradiation dose of actinic rays can be obtained, and in particular, it is preferred that the irradiation time is between 0.1 second or more and 10 minutes or less, and more preferably, between 1 second or more and 5 minutes or less in terms of curability or work efficiency.

In the present invention, the protective layer can be dried after irradiation of actinic rays and during irradiation of actinic rays, and the timing to dry the protective layer can be arbitrarily selected in combination with irradiation condition of actinic rays. Drying condition of the protective layer can be arbitrarily selected according to the type of solvent to be used in the application liquid and the thickness of the protective layer. Moreover, it is preferred that drying temperature is between room temperature ore more and 180 degrees or less, and particularly, between 80 degrees or more and 140 degrees or less is preferable. Furthermore, drying time is preferably between 1 minute or more and 200 minutes or less, and particularly, between 5 minutes or more and 100 minutes or less is preferable. In the present invention, by drying the protective layer under the above drying conditions, the amount of solvent included in the protective layer can be controlled to be in the range between 20 ppm or more and 75 ppm or less.

<<Configuration of Photoreceptor>>

(Layer Configuration of Photoreceptor)

The photoreceptor of the present invention is configured by forming a photosensitive layer and a protective layer on a conductive supporting body. With respect to the photosensitive layer, the layer configuration is not particularly limited, and the followings are examples of specific layer configuration including the protective layer.

(1) layer configuration where a charge generation layer, a charge transport layer and a protective layer are sequentially layered on a conductive support body, (2) layer configuration where a single layer including charge transport material and charge generation material and the protective layer are sequentially layered, on the conductive supporting body, (3) layer configuration where an intermediate layer, charge generation layer, charge transport layer and a protective layer are sequentially layered on the conductive supporting body and (4) layer configuration where an intermediate layer and a single layer including charge transport material and charge generation material are sequentially layered on a conductive supporting body.

The photoreceptor of the present invention can have any one of the layer configurations of the above (1) to (4), and in particular, the layer configuration where an intermediate layer, a charge generation layer, a charge transport layer and a protective layer are sequentially provided on a conductive supporting body is preferred.

FIG. 1 is a schematic view showing an example of the layer configuration of the photoreceptor of the present invention. In FIG. 1, reference numeral 1 indicates a conductive supporting body, reference numeral 2 indicates a photosensitive layer, reference numeral 3 indicates an intermediate layer, reference numeral 4 indicates a charge generation layer, reference numeral 5 indicates a charge transport layer, reference numeral 6 indicates a protective layer and reference numeral 7 indicates surface processing P-type semiconductor particles.

Next, members constituting the conductive supporting body, the intermediate layer, the photosensitive layer (charge generation layer, charge transport layer) and the photosensitive layer which constitute the photoreceptor of the present invention will be described.

(Conductive Supporting Body)

The supporting body used in the present invention can be anything as long as the supporting body has conductivity. For example, a supporting body which is formed by shaping a metal such as aluminum, copper, chromium, nickel, zinc, stainless steel and the like in a drum or a sheet, a supporting body which is formed, by laminating a metallic foil such as aluminum, copper and the like on a plastic film, a supporting body which is formed by performing vapor deposition of aluminum, indium oxide, tin oxide and the like on a plastic film, a supporting body which is formed by applying a conductive material alone or with a binder resin on a metal, a plastic film or a paper sheet to provide a conductive layer or the like are suggested.

(Intermediate Layer)

In the present invention, an intermediate layer having barrier function and adhesive function can be provided between the conductive supporting body and the photosensitive layer. The intermediate layer can be formed by performing immersion application by dissolving a binder resin such as casein, polyvinyl alcohol, cellulose nitrate, acrylic acid-ethylene copolymer, polyamide, polyurethane and gelatin in a well known solvent. Among the above binder resin, alcohol soluble polyamide resin is preferred.

Moreover, various types of conductive fine particles and metallic oxide particles can be included in the intermediate layer for the purpose of adjusting resistance. For example, various types of metallic oxide particles such as alumina, zinc oxide, titanium oxide, tin oxide, antimony oxide, indium oxide, bismuth oxide and the like, ultra-fine particles such as tin doped indium oxide, antimony doped tin oxide, zirconium oxide and the like can be used. When two types or more are mixed, it may be in a form of solid solution or fusion. With respect to such metallic oxide particles, the number average primary particle size is preferably 0.3 μm or less, and more preferably, 0.1 μm or less.

As for the solvent which can be used for forming the intermediate layer, a solvent which can disperse the inorganic fine particles such as the conductive fine particles, metallic oxide particles and the like in a good manner and dissolve the binder resin including polyamide resin is preferred. In particular, alcohols having carbon number between 2 or more and 4 or less such as ethanol, n-propyl alcohol, isopropyl alcohol, n-butanol, t-butanol, sec-butanol and the like are preferable because they bring out good solubility and applicability in polyimide resin which is preferable as binder resin. Further, in order to improve conservation and dispersibility of the inorganic fine particles, a co-solvent such as described above can be combined with the solvent. As for the co-solvent which can obtain preferable effect, methanol, benzyl alcohol, toluene, cyclohexane, tetrahydrofuran and the like are suggested.

Density of the binder resin at the time of forming the application solution can be arbitrarily selected according to the thickness of the intermediate layer and the applying method. Further, when inorganic fine particles are to be dispersed, it is preferred that the mixing ratio of the inorganic fine particles with respect to the binder resin is between 20 part per weight or more and 400 part per weight or less of inorganic fine particles with respect to 100 part per weight of the binder resin, and more preferably, between 50 part per weight or more to 200 part per weight of inorganic fine particles with respect to 100 part per weight of the binder resin.

As for the dispersion method, of inorganic fine particles, ultrasonic disperser, ball mill, sand grinder, homo mixer and the like are suggested. However, the method is not limited to these suggested, above.

Moreover, as for the drying method of the intermediate layer, a well known drying method can be arbitrarily selected according to the solvent type and the thickness to be formed, and in particular, thermal drying is preferred.

It is preferred that the thickness of intermediate layer is between 0.1 μm or more and 15 μm or less, and preferably, between 0.3 μm or more and 10 μm or less, (Photosensitive Layer)

As described above, with respect to the photosensitive layer which constitutes the photoreceptor of the present invention, the layer configuration where the function of the photosensitive layer is separated between the charge generation layer (CGL) and the charge transport layer (CTL) is more preferable besides the single layer configuration where the charge generation function and the charge transport function are given to one layer. As described above, there are advantages that increase in residual potential with repeated usage can be controlled to be small and various types of electrophotographic characteristics can be controlled easily according to purposes comparing to the layer configuration where functions are separated. The photoreceptor having negative changeability has configuration where a charge generation layer (CGL) is provided on the intermediate layer and the charge transport layer (CTL) is provided on the charge generation layer (CGL), and the photoreceptor having positive chargeability has configuration where the charge transport layer (CTL) is provided on the intermediate layer and the charge generation layer (CGL) is provided on the charge transport layer (CTL). The layered photoreceptor having negative chargeability is the preferred layer configuration of photosensitive layer.

Hereinafter, each layer of photosensitive layer of layered photoreceptor having negative changeability will be described as a specific example of photosensitive layer.

(Charge Generation Layer)

As for the charge generation layer formed in the present invention, a charge generation layer which includes a charge generation material and a binder resin and which is formed by applying a application liquid prepared by dispersing the charge generation material in the binder resin solution is preferred.

As for the charge generation material, azo raw materials such as Sudan Red and Dian Blue, quinone pigments such as pyrene quinone and anthanthrone, quinocyanine pigments, perylene pigments, indigo pigments such as indigo and thioindigo, phthalocyanine pigments are suggested. However, the charge generation material is not limited to those suggested above. These charge generation materials can be used alone or can be used in a state being dispersed in a well-known binder resin.

As for the binder resin for forming the charge generation layer, a well-known resin can be used. For example, polystylene resin, polyethylene resin, polypropylene resin, acrylic resin, methacrylic resin, vinyl chloride resin, polyvinyl acetate resin, polyvinyl butyral resin, epoxy resin, polyurethane resin, phenol resin, polyester resin, alkyd resin, polycarbonate resin, silicon resin, melamine resin, copolymers including two or more of these resins (for example, vinyl chloride-vinyl acetate copolymer resin, vinyl chloride-vinyl acetate-maleic anhydride copolymer resin), polyvinyl carbazole resin and the like are suggested. However, the binder resin is not limited to those suggested above.

As for forming of the charge generation layer, it is preferred that the charge generation layer is made by preparing an application liquid by dispersing a charge generation material in a solution in which a binder resin is dissolved in a solvent by using a disperser, applying the application liquid in even thickness by using an applier and drying the applied film.

As for the solvent to be used for dissolving and applying the binder resin used for the charge generation layer, for example, toluene, xylene, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine, diethylamide and the like are suggested. However, the solvent is not limited to these suggested above.

As for the dispersing method of charge generation material, ultrasonic disperser, ball mill, sand grinder, homo mixer and the like can be user. However, the method is not limited to these suggested above.

As for the mixing ratio of the charge generation material with respect to the binder resin, between 1 part per weight or more and 600 part per weight or less of charge generation material with respect to 100 part per weight of binder is preferred, more particularly, between 50 part per weight or more band 500 part per weight or less of charge generation material with respect to 100 part per weight of binder resin is preferred. As for thickness of the charge generation layer, although it may differ according to characteristics of the charge generation material, characteristics of the binder resin, mixing ratio thereof and the like, it is preferred to be between 0.01 μm or more and 5 μm or less, more preferably, between 0.05 μm or more and 3 μm or less. Here, generation of defects in an image can be prevented by performing filtration of the application liquid which is to be used for charge generation layer to remove foreign materials and aggregates before applying. The charge generation layer can be formed by performing vacuum deposition of the pigment.

(Charge Transport Layer)

The charge transport layer formed in the present invention is a charge transport layer which at least includes a charge transport material and a binder resin in the layer thereof and is formed by dissolving a charge transport material in a binder resin solution and applying it.

As for the charge transport material, a well-known compound can be used and the followings are suggested, for example. That are, carbazoles, oxazoles, oxadiazoles, thiazoles, thiadiazoles, triazoles, imidazoles, imidazolones, imidazolidines, bisimidazolidines, styryl compounds, hydrazine compounds, pyrazoline compounds, oxazolones, benzimidazoles, quinazolines, benzofurans, acridines, phenazines, aminostilbenes, triphenylamines, phenylenediamines, stilbenes, benzidines, poly-N-vinylcarbazole, Poly-1-vinylpyrene, poly-9-vinylanthracene and the like are suggested. These compounds can be used alone or can be used in combination of two or more types thereof.

Moreover, a well-known resin can be used for the binder resin for the charge transport layer, and the followings are suggested, for example. That are, polycarbonate resin, polyacrylate resin, polyester resin, polystyrene resin, styrene-acrylonitrile copolymer resin, polyester methacrylate resin, styrene-methacrylic ester copolymer resin and the like are suggested. Among these, polycarbonate resin is preferred, and polycarbonate resins of types such as bisphenol A (BPA), bisphenol Z (BPZ), dimethyl BPA, BPA-dimethyl BPA copolymer and the like are preferred in terms of crack resistance, abrasion resistance and charging characteristics.

The charge transport layer can be formed by a well-known method represented by the print-on method. For example, in the print-on method, the desired charge transport layer can be formed by preparing an application liquid by dissolving a binder resin and a charge transport material, applying the application liquid so as to be an even thickness and thereafter, performing drying processing. As for the solvent to dissolve the binder resin and the charge transport material, toluene, xylene, methyl ethyl ketone, cyclohexane, ethyl acetate, butyl acetate, methanol, ethanol, propanol, butanol, tetrahydrofuran, 1,4-dioxane, 1,3-dioxolane and the like are suggested. Here, the solvent which is used when preparing the application liquid for forming the charge transport layer is not limited to these suggested above.

As for the mixing ratio of the binder resin and the charge transport material, between 10 part per weight or more and 500 part per weight or less of the charge transport material with respect to 100 part per weight of the binder resin is preferred, and between 20 part per weight or more and 100 part per weight of the charge transport material with respect to 100 part per weight of the binder resin is more preferred.

As for thickness of the charge transport layer, although it may differ according to characteristics of the charge transport material, characteristics of the binder resin, mixing ratio thereof an the like, it is preferred to be between 5 μm or more and 40 μm or less, more preferably, between 10 μm or more and 30 μm or less.

A well-known antioxidant can be added in the charge transport layer and for example, antioxidants suggested in JP 2000-305291 can be used.

(Application Method of Photoreceptor)

Each of the intermediate layer, the charge generation layer, the charge transport layer, the protective layer and the like constituting the photoreceptor of the present invention can be formed by a well-known application method. In particular, dip coating method, spray coating method, spin coating method, bead coating method, blade coating method, beam coating method, circularity regulation type applying method and the like are suggested. Here, JP shou-58-189061 and JP 2005-275373 described the circularity regulation type applying method.

≤≤Image Forming Apparatus>>

The image forming apparatus according to the present invention will be described.

The image forming apparatus which realizes the advantages of the present invention includes, (1) an electrophotographic photoreceptor at least including the protective layer of the present invention, (2) a charging unit which charges the surface of the above described electrophotographic photoreceptor, (3) an exposure unit which exposes an image on the surface of the electrophotographic photoreceptor which is charged by the charging unit and forms a latent image, (4) a developing unit which forms a toner image by visualizing the latent image which is formed by the exposure unit and (5) a transfer unit which transfers the toner image which is formed on the surface of the electrophotographic photoreceptor by the developing unit on a transfer medium such as a paper sheet or on a transfer belt.

Here, it is preferred that a non-contact charging device is used as the charging unit which charges the electrophotographic photoreceptor. As for the non-contact charging device, a corona charging device, a corotron charging device, a scorotron charging device and the like are suggested.

Figure 2:
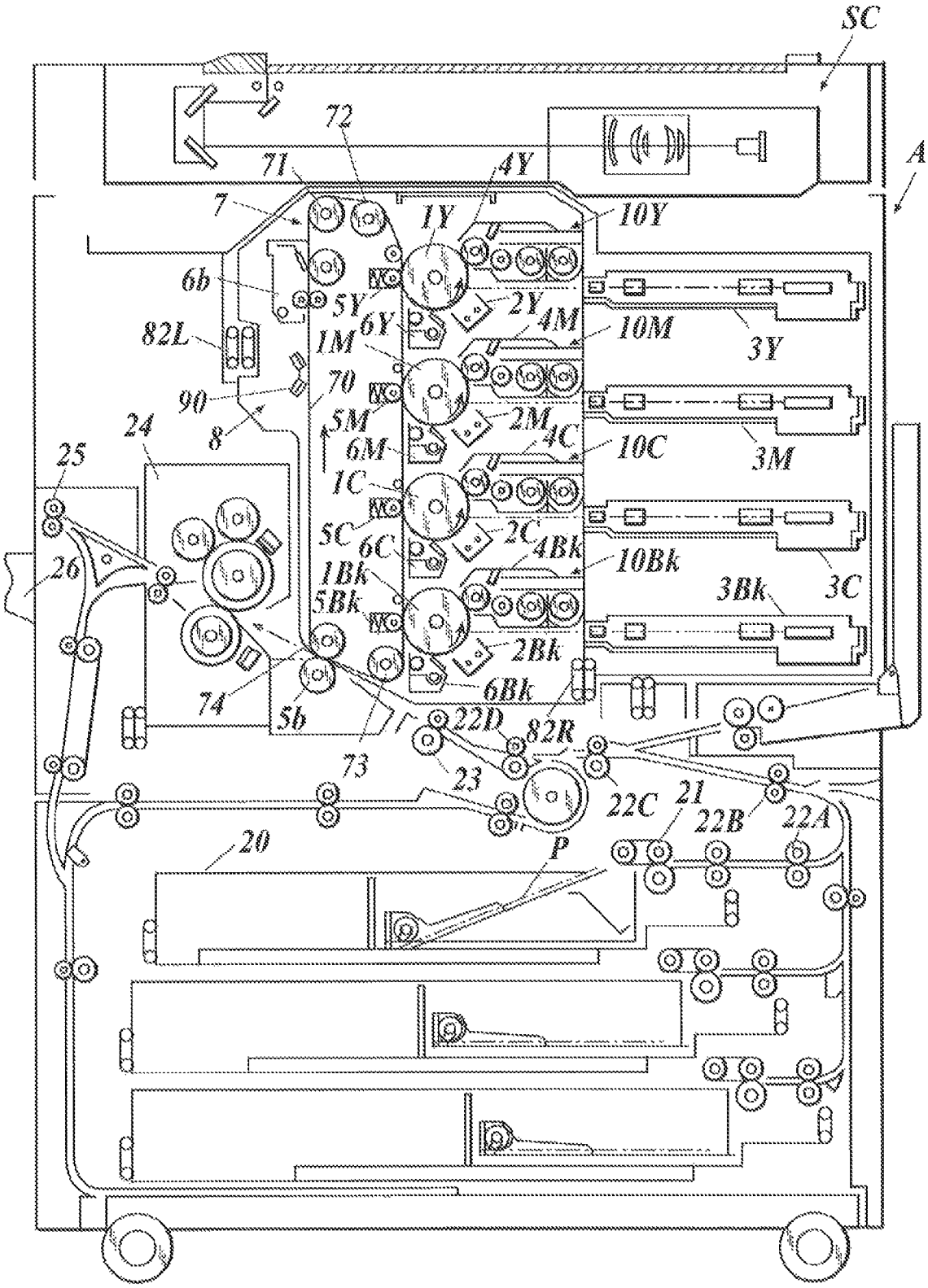
FIG. 2 is a sectional schematic view showing an example of an image forming apparatus using the photoreceptor according to the present invention.

FIG. 2 is a schematic view of a sectional diagram for explaining an example of a color image forming apparatus which shows one of the embodiments of the present invention.

The color image forming apparatus is called the tandem type color image forming apparatus, and the color image forming apparatus includes four image forming sections (image forming units) 10Y, 10M, 10C and 10Bk, an endless belt shaped intermediate transfer unit 7, a paper feeding/conveyance unit 21 and a fixing unit 24. A document image reading device SC is disposed on the main body A of the image forming apparatus.

The image forming unit 10Y which forms yellow image includes a charging unit (charging step) 2Y, an exposure unit (exposure step) 3Y, a developing unit (developing step) 4Y, a primary transfer roller 5Y as a primary transfer unit (primary transfer step) and a cleaning unit 6Y which are disposed around the drum-shaped photoreceptor 1Y as the first image holding body. The image forming unit 10M which forms magenta image includes a drum-shaped photoreceptor 1M as the first image holding body, a charging unit 2M, an exposure unit 3M, a developing unit 4M, a primary transfer roller 5M as a primary transfer unit and a cleaning unit 6M. The image forming unit 10C which forms cyan image includes a drum-shaped photoreceptor 1C as the first image holding body, a charging unit 2C, an exposure unit 3C, a developing unit 4C, a primary transfer roller 5C as a primary transfer unit and a cleaning unit 6C. The image forming unit 10Bk which forms black image includes a drum-shaped photoreceptor 1Bk as the first image holding body, a charging unit 2Bk, an exposure unit 3Bk, a developing unit 4Bk, a primary transfer roller 5Bk as a primary transfer unit and a cleaning-unit 6Bk.

The four image forming units 10Y, 10M, 10C and 10Bk are configured by including the charging units 2Y, 2M, 2C and 2Bk, the image exposure unit 3Y, 3M, 3C and 3Bk, the developing unit 4Y, 4M, 4C and 4Bk and the cleaning units 6Y, 6M, 6C and 6Bk which respectively cleans the photoreceptor drums 1Y, 1M, 1C and 1Bk centering around the photoreceptor drums 1Y, M, 1C and 1Bk, respectively.

With respect to the image forming units 10Y, 10M, 10C and 10Bk, only the colors of the toner images which are formed by the image forming units 10Y, 10M, 10C and 10Bk are different, and other configurations are the same. Therefore, description will be given by taking the image forming unit 10Y as an example.

In the image forming unit 10Y, the charging unit 2Y (hereinafter, merely called the charging unit 2Y or charger Y), the exposure unit 3Y, the developing unit 4Y and the cleaning unit 6Y (hereinafter, merely called the cleaning unit 6Y or the cleaning blade 6Y) are disposed around the photoreceptor drum 1Y which is the image forming body, and the image forming unit 10Y forms a toner image of yellow (Y) on the photoreceptor drum 1Y. Further, in the embodiment, among the image forming unit 10Y, at least the photoreceptor drum 1Y, the charging unit 2Y, the developing unit 4Y and the cleaning unit 6Y are provided integrally.

The charging unit 2Y is a unit for uniformly applying potential to the photoreceptor drum 1Y, and in the embodiment, the corona type charger 2Y is used for the photoreceptor drum 1Y.

The image exposure unit 3Y is a unit which performs exposure on the basis of the image signal (yellow) on the photoreceptor drum 1Y to which potential is applied uniformly by the charger 2Y and forms an electrostatic latent image which corresponds to the yellow image. As for the exposure unit 3Y, a unit which is structured of LEDs and imaging elements (brand name: Selfoc (registered trademark) lens) in which light emitting elements are arranged in an array format in the axis direction of the photoreceptor drum 1Y or a laser optic system is used.

With respect to the image forming apparatus of the present invention, the constituents such as the above described photoreceptor, developer, cleaner and the like can be integrally joint as a process cartridge (image forming unit), and the image forming unit can be detachable with respect to the apparatus main body. Further, at least one of the charger, image exposure, transfer/separator and cleaner can be held integrally with the photoreceptor to form a process cartridge (image forming unit) as an individual image forming unit which is detachable to the apparatus main body, and the image forming unit can be detachable by using a guiding unit such as a rail or the like of the apparatus main body.

The endless belt shaped intermediate transfer unit 7 goes around a plurality of rollers and includes an endless belt shaped intermediate transfer body 70 as the second image holding body of semiconductor endless belt shape which is supported so as to rotate.

Images of each color formed by the image forming units 10Y, 10M, 10C and 10Bk are sequentially transferred on the endless belt shaped intermediate transfer body 70 which rotates by the primary transfer rollers 5Y, 5M, 5C and 5Bk as the primary transfer unit, respectively. The transferring material P as the transferring material (supporting body which holds the final image which is fixed: for example, regular paper, transparent sheet and the like) housed in the feeing cassette 20 is fed by the feeing unit 21, conveyed to the secondary transfer roller 5*b* as the secondary transfer unit via a plurality of intermediate rollers 22A, 22B, 22C and 22D and the resist roller 23 and a color image is transferred as a whole on the transferring material P by the secondary transfer. Fixing processing is performed, on the transferring material P on which the color image is transferred by the fixing unit 24 and the transferring material P is nipped by the discharging roller 25 to be placed on the outside ejection tray 26. Here, the transfer supporting body of the toner image which is formed on the photoreceptor such as the intermediate transferring body and the transferring body are called the transfer medium as a whole.

On the other hand, after the color image is transferred onto the transferring material P by the secondary transfer roller 5*b* as the secondary transfer unit, residual toner is to be removed from the endless belt shaped intermediate transfer body 70 from which the transferring material P is separated by curvature by the deeming unit 6*b*.

During the image forming processing, the primary transfer roller 5Bk always contacts the photoreceptor 1 Bk. The other primary transfer rollers 5Y, 5M and 5C contact their respective photoreceptors 1Y, 1M and 1C only at the lime of color image forming.

The secondary transfer roller 5*b* contacts the endless belt shaped intermediate transfer body 70 only when the transferring material P passed through the secondary transfer roller 5*b* so that the secondary transfer is to be performed.

Moreover, the case 8 can be pulled out from the apparatus main body A via the supporting rails 82L and 82R.

The case 8 is formed of the image forming units 10Y, 10M, 10C and 10Bk and the endless belt shaped intermediate transfer unit 7.

The image forming units 10Y, 10M, 10C and 10Bk are arranged in tandem along the vertical direction. On the left side of the photoreceptors 1Y, 1M, 1C and 1Bk in the drawing, the endless belt shaped intermediate transfer unit 7 is disposed. The endless belt shaped intermediate transfer unit 7 is formed of the endless belt shaped intermediate transfer body 70 which can rotate by winding the rollers 71, 72, 73 and 74, the primary transfer rollers 5Y, 5M, 5C and 5Bk and the cleaning unit 6*b*.

Experimental Example

Hereinafter, the present invention will be specifically described using experimental examples. However, the present invention is not limited, to the experimental examples.

<Preparing of Surface Processing Particles>

(Preparation of Surface Processing Particles 1)

In the wet-type sand mill (alumina beads of 0.5 mm diameter), 100 part per weight of "$CuAlO_2$" where number average primary particle size is 20 nm as the P-type semiconductor particles, 10 part per weight of "Poly (methylhydrosiloxane) (KF-99: manufactured by Shin-Etsu Chemical Co., Ltd.)" as the surface processing agent and 1000 part per weight of methyl ethyl ketone are put in and mixed for 6 hours at 30 degrees temperature. Thereafter, methyl ethyl ketone and alumina beads are filtered to be removed, and "surface processing particles 1" are prepared by drying the mixture at 60 degrees temperature.

(Preparation of Surface Processing Particles 2)

"Surface processing particles 2" are prepared similarly as the surface processing particles 1 except that "hexamethyldisilazane" is used as the surface processing agent.

(Preparation of Surface Processing Particles 3)

"Surface processing particles 3" are prepared similarly as the surface processing particles 1 except that "$CuAlO_2$" of number average primary particle size 30 nm is used as the P-type semiconductor particles and the "exemplified compound S-15" is used, as the surface processing agent.

(Preparation of Surface Processing Particles 4)

"Surface processing particles 4" are prepared similarly as the surface processing particles 1 except that "$CuInO_2$" of number average particles size 30 nm is used as the P-type semiconductor particles and the "exemplified compound S15" is used as the surface processing agent.

(Preparation of Surface Processing Particles 5)

"Surface processing particles 5" are prepared similarly as the surface processing particles 1 except that "$CuInO_2$" of number average particles size 50 nm is used as the P-type semiconductor particles and the "exemplified compound S-15" is used as the surface processing agent.

(Preparation of Surface Processing Particles 6)

"Surface processing particles 6" are prepared similarly as the surface processing particles 1 except that "$CuGaO_2$" of number average particles size 100 nm is used as the P-type semiconductor particles and the "exemplified compound S-30" is used as the surface processing agent.

(Preparation of Surface Processing Particles 7)

"Surface processing particles 7" are prepared similarly as the surface processing particles 1 except that "$CuGaO_2$" of number average particles size 100 nm is used as the P-type semiconductor particles and the "exemplified compound S-35" is used as the surface processing agent.

(Preparation of Surface Processing Particles 8 (For Comparison))

"Surface processing particles 8 (for comparison)" are prepared similarly as the surf ace processing particles 1 except that "$SnO_2$" of number average particles size 20 nm is used as the metallic oxide particles and the "exemplified compound S-15" is used as the surface processing agent.

(Preparation of Surface Processing Particles 9 (For Comparison))

"Surface processing particles 9 (for comparison)" are prepared similarly as the surface processing particles 1 except that 100 part per weight of "$SiO_2$" of number average particles size 50 nm are used, as the metallic oxide particles and 100 part per weight of "dimethylpolysiloxane (KF-96-10cs: manufactured by Shin-Etsu Chemical Co., Ltd.)" are used as the surface processing agent.

Configurations of the surface processing particles prepared as described above are shown in table 1.

TABLE 1

| surface processing particles No. | particle type | | primary particle size (nm) | surface processing agent type | particle/surface processing agent (part per weight) |
|---|---|---|---|---|---|
| 1 | $CuAlO_2$ | P-type semiconductor | 20 | KF-99 | 100/10 |
| 2 | $CuAlO_2$ | P-type semiconductor | 20 | HMDS | 100/10 |
| 3 | $CuAlO_2$ | P-type semiconductor | 30 | S-15 | 100/10 |
| 4 | $CuInO_2$ | P-type semiconductor | 30 | S-15 | 100/10 |
| 5 | $CuInO_2$ | P-type semiconductor | 50 | S-15 | 100/10 |
| 6 | $CuGaO_2$ | P-type semiconductor | 100 | S-30 | 100/10 |
| 7 | $CuGaO_2$ | P-type semiconductor | 100 | S-35 | 100/10 |
| 8 | $SnO_2$ | metallic oxide | 20 | S-15 | 100/10 |
| 9 | $SnO_2$ | metallic oxide | 50 | KF-96-10cs | 100/100 |

<Preparation of the Photoreceptor 1>

The photoreceptor 1 is prepared as described below.

Cutting is performed on the surface of the cylindrical aluminum supporting body wherein its diameter is 60 mm, and a conductive supporting body wherein the surface roughness Rz=1.5 (μm) is prepared.

(Intermediate Layer)

The intermediate layer application liquid is prepared by diluting the dispersing liquid of the following composition twice with the same solvent and filtering after letting the diluted liquid sit still for over one night (filter: use Rigimesh 5 μm filter manufactured by Nihon Poll Ltd.).

Polyamide resin CM8000 (manufactured by Toray Industries, Inc.): 1 part per weight Titanium oxide SMT500SAS (manufactured by Tayca Corporation): 3 part per weight Methanol: 10 part per weight Dispersion is performed for 10 hours in a batch method by using a sand mill as the disperser.

The above application liquid is applied on the supporting body by a dip coating method so that the dry film thickness will be 2 μm.

<Charge Generation Layer>

Charge generation material: Titanyl-phthalocyanine pigment (Titanyl-phthalocyanine pigment having the maximum diffraction peak at least at the position of 27.3 degrees in Cu—Kα characteristic X-ray diffraction spectrum measurement): 20 part per weight Polyvinyl butyral resin (#6000-C: manufactured by DENKI KAGAKU KOGYO KABUSHIKI KAISHA): 1—part per weight Tert-Butyl acetate: 700 part per weight 4-Methoxy-4-methyl-2-pentanone: 300 part per weight are mixed, and dispersed for 10 hours by using a sand mill to prepare the charge generation layer application liquid. This application liquid is applied by a dip coating method on the intermediate layer and the charge generation layer of 0.3 μm dry film thickness is formed.

<Charge Transport Layer>

Charge transport material (4,4'-dimethyl-4"-(β-phenyl styryl)triphenylamine: 225 part per weight Binder: polycarbonate (Z300: manufactured by MITSUBISHI GAS CHEMICAL COMPANY, INC.): 300 part per weight Antioxidant (Irganox1010: manufactured by BASF Japan Ltd.): 6 part per weight THF: 1600 part per weight Toluene: 400 part per weight Silicone oil (KF-54: manufactured by Shin-Etsu Chemical Co., Ltd.): 1 part per weight are mixed and dissolved to prepare the charge transport layer application liquid. This application liquid is applied on the charge generation layer by the dip coating method to form the charge transport layer having dry film thickness of 20 μm.

<Protective Layer>

Surface processing particles 1: 100 part per weight

Binder (curable compound: exemplified compound M1): 100 part per weight

Polymerization initiator (Irgacure 819: manufactured by BASF Japan Ltd.): 15 part per weight 2-butanol: 500 part per weight The above components are mixed and stirred, sufficiently dissolved and dispersed to prepare the protective layer application liquid. This application liquid is applied, on the photoreceptor wherein up to the charge transport layer is formed by using a circular slide hopper applier to form the protective layer. After the application, ultraviolet, rays are emitted for one minute by using a xenon lamp and the protective layer having dry film thickness of 2.0 μm is obtained. In such way, "photoreceptor 1" is prepared.

<Preparation of Photoreceptor 2 and Photoreceptor 10>

The protective layer of the photoreceptor 1 is changed as shown in table 2 and application is performed similarly. After the application, drying is performed for 70 minutes at 120 degrees temperature and the protective layer having dry film thickness of 2.0 μm is obtained. In such way, "photoreceptor 2" and "photoreceptor 10" are prepared. Here, curable compound is not used in the protective layers and polycarbonate Z300 (manufactured by MITSUBISHI GAS CHEMICAL COMPANY, INC.) is used as the binder. Further, 50 part per weight of CTM-1 having the following configuration formula is added in the protective layer of the photoreceptor 10 as the charge transport material.

<Preparation of Photoreceptors 3 to 9>

The photoreceptors 3 to 9 are prepared similarly except that the protective of the photoreceptor 1 is changed as shown in table 2. Further, surface processing particles are not added, in the protective layer of the photoreceptor 8 and 100 part per weight of RCTM having the following configuration formula is added as the charge transport material.

Here, photoreceptors 1 to 7 are the photoreceptors of the present invention and photoreceptors 8 to 10 are photoreceptors for comparison.

[Chemical 4]

CTM-1

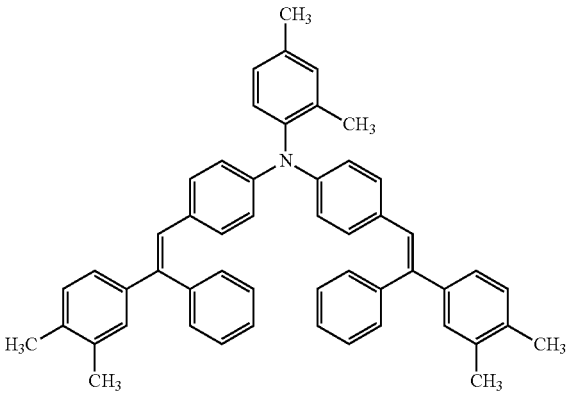

RCTM

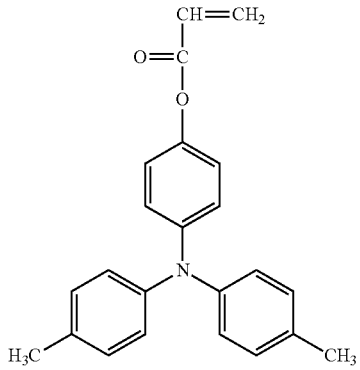

TABLE 2

| | protection layer | | | | | | | | | |
|---|---|---|---|---|---|---|---|---|---|---|
| | surface processing particle | | binder | | charge transport material | | polymerization initiator | | | |
| photoreceptor No. | No. | adding amount (part per weight) | type | adding amount (part per weight) | type | adding amount (part per weight) | type | adding amount (part per weight) | curing method | note |
| 1 | 1 | 100 | M1 | 100 | — | — | Irgacure 819 | 15 | light | present invention |
| 2 | 2 | 100 | Z300 | 100 | — | — | — | — | — | present invention |
| 3 | 3 | 100 | M1 | 100 | — | — | Irgacure 819 | 15 | light | present invention |
| 4 | 4 | 100 | M1 | 100 | — | — | Irgacure 819 | 15 | light | present invention |
| 5 | 5 | 100 | M12 | 100 | — | — | Irgacure 819 | 10 | light | present invention |
| 6 | 6 | 100 | M14 | 50 | — | — | Irgacure 819 | 15 | light | present invention |

TABLE 2-continued

| | protection layer | | | | | | | | | |
|---|---|---|---|---|---|---|---|---|---|---|
| | surface processing particle | | binder | | charge transport material | | polymerization initiator | | | |
| photoreceptor No. | No. | adding amount (part per weight) | type | adding amount (part per weight) | type | adding amount (part per weight) | type | adding amount (part per weight) | curing method | note |
| 7 | 7 | 100 | M1 | 100 | — | — | Irgacure 369 | 15 | light | present invention |
| 8 | — | | M1 | 100 | RCTM | 100 | Irgacure 819 | 30 | light | comparison |
| 9 | 8 | 150 | M1 | 100 | — | — | Irgacure 819 | 30 | light | comparison |
| 10 | 9 | 100 | Z300 | 100 | CTM-1 | 50 | — | — | — | comparison |

<Evaluation of Photoreceptors>

As an evaluator, "bizhub PRO C6501" manufactured by Konica Minolta Business Technologies, Inc. which basically included the configuration of FIG. 1 is used. Bach, of the photoreceptors is loaded in the evaluator and evaluation was carried out.

Under the environment of 23 degrees/50% RH, endurance test where continuous printing of a text image of 6% ratio picture on both sides, 300,000 sheets each, where A4 size paper sheets are cross fed was carried out. During the texting or after the test, evaluations on abrasion resistance, residual potential and image memory of the photoreceptors were carried out. Here, evaluations were carried out following the index described below.

[Evaluation of Abrasion Resistance]

Film thickness of each photoreceptor was measured before and after the endurance test and the decrease in film thickness due to abrasion was calculated and evaluated.

With respect to the film thickness of the photoreceptor, randomly selected 10 points in the uniform film thickness part (film thickness varying part, such as tip section of application and end section of application are removed by preparing a film thickness profile) are measured and the average value thereof is set as the film thickness of the photosensitive layer. As for the film thickness measuring device, an eddy current type film thickness measuring decide "EDDY560C" (manufactured by HELMUT FISCHER GMBTE CO) is used, and the difference in the film thickness of photosensitive layer before and after the printing test is set as the decrease in film thickness. Table 3 shows α values (μm/100,000 rotations) expressing the decrease amount (μm) per 100 krot (100,000 rotations).

[Evaluation of Image Memory]

After the endurance test, 10 sheets of images where solid black and solid white are mixed are continuously printed and thereafter, an even halftone image is printed, and whether any record of solid black and solid white appears in the halftone image (memory occurred) or not (memory is not occurred) was evaluated.

A: memory occurred

B: memory is not occurred

[Evaluation of Potential After Exposure]

Potential after exposure was measured as the index for potential characteristic of each photoreceptor. As for the evaluation, potential (residual potential) on the surface of each photoreceptor after exposure was measured by charging the photoreceptor by the scorotron charging device in a dark place so that the surface potential thereof will be −500V and performing white exposure of 148 μW/cm2 strength after 33 msec under the condition of 20 degrees temperature and 65% RH by using "CYNTHIA59" manufactured by GEN-TECH, INC.).

The above evaluation results are shown in table 3.

TABLE 3

| | evaluation reuslt | | | |
|---|---|---|---|---|
| photoreceptor No. | abrasion resistance (α value) (μm/100000) | image memory | residual potential | note |
| 1 | 0.18 | A | −55 | present invention |
| 2 | 0.23 | A | −66 | present invention |
| 3 | 0.04 | A | −58 | present invention |
| 4 | 0.13 | A | −72 | present invention |
| 5 | 0.10 | A | −74 | present invention |
| 6 | 0.12 | A | −57 | present invention |
| 7 | 0.15 | A | −61 | present invention |
| 8 | 0.45 | A | −128 | comparison |
| 9 | 0.30 | B | −88 | comparison |
| 10 | 0.88 | A | −64 | comparison |

As it is clear from the above results, it can be understood that the photoreceptors 1 to 7 of the present invention are photoreceptors having better characteristics with regard to each characteristic of abrasion resistance, image memory and residual potential comparing to the photoreceptors 8 to 10 for comparison.

The entire disclosure of Japanese Patent Application No. 2011-278006 filed on Dec. 20, 2011 is incorporated herein by reference in its entirety.

What is claimed is:

1. An electrophotographic photoreceptor, comprising:

a conductive supporting body;

a photosensitive layer; and a protective layer, wherein at least the photosensitive layer and the protective layer are sequentially layered on the conductive supporting body, the protective layer includes P-type semiconductor particles, and the P-type semiconductor particles are a compound ex pressed by a general formula (1)

$$CuMO_2 \qquad \text{General formula (1)}$$

wherein M is an element of group 13 in periodic table.

2. The electrophotographic photoreceptor according to claim 1, wherein the P-type semiconductor particles are particles selected from $CuAlO_2$, $CuGaO_2$ and $CuInO_2$.

3. The electrophotographic photoreceptor according to claim 1, wherein the protective layer further includes a component obtained by curing a curable compound.

4. The electrophotographic photoreceptor according to claim 3, wherein the curable compound is a polymerizable monomer including at least either of an acryloyl group and a methacryloyl group in a molecule thereof.

5. The electrophotographic photoreceptor according to claim 1, wherein the P-type semiconductor particles are treated with a surface processing agent including a reactive organic group.

6. The electrophotographic photoreceptor according to claim 1, wherein a number average primary particle size of the P-type semiconductor particles is between 1 nm or more and 300 nm or less.

7. The electrophotographic photoreceptor according to claim 1, wherein the P-type semiconductor particles are particles prepared by a plasma method.

8. An electrophotographic photoreceptor, comprising:

a conductive supporting body;

a photosensitive layer; and a protective layer, wherein at least the photosensitive layer and the protective layer are sequentially layered on the conductive supporting body, and the protective layer includes P-type semiconductor particles and a component obtained by curing a curable compound.

9. The electrophotographic photoreceptor according to claim 8, wherein the P-type semiconductor particles are treated with a surface processing agent including a reactive organic group.

10. The electrophotographic photoreceptor according to claim 8, wherein the curable compound is a polymerizable monomer including at least either of an acryloyl group and a methacryloyl group in a molecule thereof.

11. The electrophotographic photoreceptor according to claim 8, wherein a number average primary particle size of the P-type semiconductor particles is between 1 nm or more and 300 nm or less.

12. The electrophotographic photoreceptor according to claim 8, wherein the P-type semiconductor particles are particles prepared by a plasma method.

13. An electrophotographic photoreceptor, comprising:

a conductive supporting body;

a photosensitive layer; and a protective layer, wherein at least the photosensitive layer and the protective layer are sequentially layered on the conductive supporting body, and the protective layer includes P-type semiconductor particles and a binder resin.

14. The electrophotographic photoreceptor according to claim 13, wherein the binder resin is a polyester resin, a polycarbonate resin, a polyurethane resin or a silicone resin.

15. The electrophotographic photoreceptor according to claim 14, wherein the binder resin is a polycarbonate resin.

16. The electrophotographic photoreceptor according to claim 13, wherein the photosensitive layer has a layer configuration where a charge generation layer and a charge transport layer are sequentially layered on a conductive support body or a layer configuration where a single layer including a charge transport material and a charge generation material is layered on the conductive supporting body.

17. The electrophotographic photoreceptor according to claim 16, wherein the photosensitive layer has the layer configuration where the charge generation layer and the charge transport layer are sequentially layered on the conductive support body.

18. The electrophotographic photoreceptor according to claim 13, wherein the P-type semiconductor particles are a compound expressed by a general formula (1)

$$CuMO_2 \qquad \text{General formula (1)}$$

wherein M is an element of group 13 in periodic table.

19. The electrophotographic photoreceptor according to claim 13, wherein a number average primary particle size of the P-type semiconductor particles is between 1 nm or more and 300 nm or less.

* * * * *